US009044987B2

(12) United States Patent
Noguchi et al.

(10) Patent No.: US 9,044,987 B2
(45) Date of Patent: Jun. 2, 2015

(54) RECORDING MEDIUM

(71) Applicant: CANON KABUSHIKI KAISHA, Tokyo (JP)

(72) Inventors: Tetsuro Noguchi, Hachioji (JP); Hisao Kamo, Ushiku (JP); Isamu Oguri, Yokohama (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/451,319

(22) Filed: Aug. 4, 2014

(65) Prior Publication Data

US 2015/0044396 A1 Feb. 12, 2015

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/502* (2013.01); *B41M 2205/42* (2013.01); *B41M 5/508* (2013.01); *B41M 5/506* (2013.01)

(58) Field of Classification Search

CPC .... B41M 5/2518; B41M 5/502; B41M 5/506; B41M 5/508

USPC ..... 428/32.24, 32.25, 32.34, 32.35

See application file for complete search history.

(56) References Cited

U.S. PATENT DOCUMENTS

| | | | | |
|---|---|---|---|---|
| 4,460,637 | A * | 7/1984 | Miyamoto et al. | 428/32.32 |
| 2003/0224129 | A1 * | 12/2003 | Miyachi et al. | 428/32.1 |
| 2009/0123655 | A1 * | 5/2009 | Shaw-Klein et al. | 427/411 |

FOREIGN PATENT DOCUMENTS

| | | | |
|---|---|---|---|
| EP | 2138320 | A1 | 12/2009 |
| EP | 2332734 | A1 | 6/2011 |
| JP | 07-101142 | A | 4/1995 |
| JP | 2004-050811 | A | 2/2004 |
| JP | 2010-030291 | A | 2/2010 |
| JP | 2011-140214 | A | 7/2011 |

* cited by examiner

*Primary Examiner* — Betelhem Shewareged

(74) *Attorney, Agent, or Firm* — Canon USA Inc. IP Division

(57) ABSTRACT

A recording medium has a base, a first ink receiving layer, and a second ink receiving layer that is the outermost layer in the stated order, in which the first ink receiving layer is a layer adjacent to the second ink receiving layer, the first ink receiving layer contains fumed silica, the second ink receiving layer contains colloidal silica and resin particles, and the area in which the colloidal silica exists in the recording medium surface is 10% or more and 70% or less.

9 Claims, No Drawings

RECORDING MEDIUM

BACKGROUND OF THE INVENTION

1. Field of the Invention

The present invention relates to a recording medium.

2. Description of the Related Art

As a recording medium for use in an ink jet recording method and the like, a recording medium having a porous ink absorbing layer containing inorganic particles on a base is known. In such a porous ink receiving layer, when the number of voids is large, the refractive index of the ink receiving layer is low. Therefore, there is a tendency for the reflectivity on the ink receiving layer surface to decrease, and thus the glossiness of the recording medium decreases. Then, as a method of improving the glossiness of the recording medium, a method of providing a gloss layer containing colloidal silica on the outermost surface of the recording medium is known (Japanese Patent Laid-Open Nos. 2004-050811, 2010-030291, 7-101142, and 2011-140214). A reason why the glossiness of the recording medium improves as a result of the recording medium containing the colloidal silica is as follows. The colloidal silica is likely to take a configuration in which the colloidal silica is densely packed when the ink receiving layer is formed as compared with the other inorganic particles. Therefore, since the number of voids, which lead to a decrease in glossiness, decreases, the glossiness becomes high.

Japanese Patent Laid-Open Nos. 2004-050811 and 2010-030291 describe a recording medium having a base, a porous ink receiving layer, and an outermost layer containing colloidal silica in the stated order. Japanese Patent Laid-Open No. 7-101142 describes a recording medium having an outermost layer containing colloidal silica and resin particles. Japanese Patent Laid-Open No. 2011-140214 describes a recording medium having an outermost layer containing colloidal silica, polyvinyl alcohol, and cationic polyurethane emulsion particles on an ink receiving layer containing alumina hydrate.

SUMMARY OF THE INVENTION

A recording medium according to the present invention has a base, a first ink receiving layer, and a second ink receiving layer that is the outermost layer in the stated order, in which the first ink receiving layer is a layer adjacent to the second ink receiving layer, the first ink receiving layer contains fumed silica, the second ink receiving layer contains colloidal silica and resin particles, and the area in which the colloidal silica exists in the recording medium surface is 10% or more and 70% or less.

Further features of the present invention will become apparent from the following description of exemplary embodiments.

DESCRIPTION OF THE EMBODIMENTS

According to an examination performed by the present inventors, in the recording media described in Japanese Patent Laid-Open Nos. 2004-050811, 2010-030291, 7-101142, and 2011-140214, although the glossiness has been improved, the ink absorbability has been low in some cases. Specifically, the recording media described in Japanese Patent Laid-Open Nos. 2004-050811, 2010-030291, and 7-101142, the ink absorbability has been low, and therefore a beading has occurred in an image to be obtained in some cases. In the recording medium described in Japanese Patent Laid-Open No. 2011-140214, the ink absorbability has not been sufficient and the glossiness also has had room for improvement.

Hereinafter, the present invention is described in detail with reference to preferable embodiments.

The present inventors have first examined a cause of the reduction in the ink absorbability in the recording medium having an ink receiving layer containing colloidal silica.

As described above, the colloidal silica is likely to take a configuration in which the colloidal silica is densely packed, and therefore voids tend to decrease. Thus, the glossiness of the recording medium becomes high due to the number of the voids is small but, on the other hand, since ink is absorbed by the voids, the ink absorbability becomes low due to the number of the voids is small. More specifically, when only the amount of the voids is adjusted, the glossiness and the ink absorbability have a trade-off relationship with each other.

Then, the present inventors have increased the voids by reducing the amount of the colloidal silica to some extent to thereby increase the ink absorbability. Specifically, it has been found that the ink absorbability sufficiently improves by setting the area in which the colloidal silica exists in the recording medium surface to 70% or less. However, as described above, the glossiness decreases simply by reducing the amount of the colloidal silica. Then, the glossiness is increased by the other methods. Specifically, resin particles are further incorporated in the outermost layer containing colloidal silica (second ink receiving layer) and also fumed silica is incorporated in the ink receiving layer (first ink receiving layer) adjacent to the outermost layer containing colloidal silica.

When the resin particles are incorporated in the second ink receiving layer, the resin particles themselves have glossiness and also the resin particles enter a region in which the colloidal silica does not exist, so that the recording medium surface becomes smoother, whereby the glossiness of the recording medium improves. Moreover, due to the fact that fumed silica is contained in the first ink receiving layer which is the layer adjacent to the outermost layer, the refractive-index difference between the first ink receiving layer and the second ink receiving layer which is the outermost layer becomes large, so that reflectivity of light on the interface of the first ink receiving layer and the second ink receiving layer becomes high, and therefore the glossiness of the recording medium improves. Since the resin particles can be swollen by absorbing ink, the ink absorbability is not impaired even when the resin particles are densely packed.

When the present inventors have further examined, it has been found that the improvement effect of the glossiness by the use of the resin particles and the fumed silica is revealed when the area in which the colloidal silica exists in the recording medium surface is 10% or more. It has been found that when the area in which the colloidal silica exists in the recording medium surface is smaller than 10%, the improvement effect of the glossiness by the colloidal silica is low and even when the resin particles and the fumed silica are used, the glossiness as the entire recording medium is not sufficiently obtained.

As in the above-described mechanism, because each element affects each other in a synergistic manner, the effects of the present invention can be achieved.

Recording Medium

The recording medium of the present invention has a base, a first ink receiving layer, and a second ink receiving layer in the stated order. The second ink receiving layer is the outermost layer of the recording medium and the first ink receiving layer is a layer adjacent to the second ink receiving layer. In the present invention, it is preferable that the recording medium is used as an ink jet recording medium for use in the ink jet recording method.

In the present invention, the arithmetic average roughness Ra specified by JIS B 0601:2001 of the recording medium surface is preferably 1.0 μm or less, more preferably 0.5 μm or less, and particularly preferably 0.2 μm or less. Examples of a method of adjusting the surface roughness of the recording medium include a method of, using a resin coating base pressing a roll having specific irregularities or a smooth roll against the surface of the resin coating base, and then applying an ink receiving layer coating liquid onto the surface, a method of pressing a roll having specific irregularities or a smooth roll against the surface of the recording medium, and the like.

Hereinafter, each component constituting the recording medium of the present invention is described.

Base

Examples of materials which can be used for a base include paper, film, glass, metal, and the like. Among the above, a base containing paper, i.e., a so-called base paper, is preferably used.

When using the base paper, the base may be formed only with the base paper or one in which the base paper is covered with a resin layer may be used as the base. In the present invention, the base having the base paper and a resin layer is preferably used. In this case, the resin layer may be provided only on one surface of the base paper but is preferably provided on both surfaces.

The film thickness of the base is preferably 25 μm or more and 500 μm or less and more preferably 50 μm or more and 300 μm or less.

Base Paper

The base paper is made using wood pulp as the main material and, as required, adding synthetic pulp, such as polypropylene, and synthetic fibers, such as nylon and polyester. Examples of the wood pulp include leaf bleached kraft pulp (LBKP), leaf bleached sulphite pulp (LBSP), northern bleached kraft pulp (NBKP), northern bleached sulphite pulp (NBSP), leaf dissolving pulp (LDP), northern dissolving pulp (NDP), leaf unbleached kraft pulp (LUKP), northern unbleached kraft pulp (NUKP), and the like. One or two or more kinds thereof can be used as required. Among the wood pulp, LBKP, NBSP, LBSP, NDP, and LDP containing short fiber components in a high proportion are preferably used. As the pulp, chemical pulp with few impurities (sulfate pulp and sulfite pulp) is preferable. Moreover, pulp whose degree of whiteness is improved by performing bleaching treatment is also preferable. Into the base paper, a sizing agent, a white pigment, a paper reinforcing agent, a fluorescent brightening agent, a moisture maintenance agent, a dispersing agent, a softening agent, and the like may be added as appropriate.

In the present invention, the film thickness of the base paper is preferably 50 μm or more and 500 μm or less and more preferably 90 μm or more and 300 μm or less. In the present invention, the film thickness of the base paper is calculated by the following method. First, the cross section of the recording medium is cut out by using a microtome, and then the cross section is observed under a scanning electron microscope. Then, the film thickness of arbitrary 100 or more points of the base paper is measured, and the average value is defined as the film thickness of the base paper. The film thickness of the other layers in the present invention is also calculated by the similar method.

In the present invention, the paper density specified by JIS P 8118 of the base paper is preferably 0.6 g/cm$^3$ or more and 1.2 g/cm$^3$ or less. Furthermore, the paper density is more preferably 0.7 g/cm$^3$ or more and 1.2 g/cm$^3$ or less.

Resin Layer

In the present invention, when the base paper is covered with resin, the resin layer may be provided in such a manner as to partially cover the base paper surface. Furthermore, the coverage (Area of base paper surface covered with resin layer/Entire area of base paper surface) of the resin layer is preferably 70% or more, more preferably 90% or more, and particularly preferably 100%, i.e., the entire surface of the base paper surface is covered with the resin layer.

Moreover, in the present invention, the film thickness of the resin layer is preferably 20 μm or more and 60 μm or less and more preferably 35 μm or more and 50 μm or less. When providing the resin layer on both surfaces of the base paper, it is preferable for the film thickness of each of the resin layers on both surfaces to satisfy the range above.

Moreover, it is preferable that the 60° specular gloss specified by JIS Z 8741 of the resin layer is 25% or more and 75% or less. Furthermore, it is preferable that the ten-point average roughness specified by JIS B 0601:2001 of the resin layer is 0.5 μm or less.

As the resin for use in the resin layer, thermoplastic resin is preferable. Examples of the thermoplastic resin include acrylic resin, acrylic silicone resin, polyolefin resin, a styrene-butadiene copolymer, and the like. Among the above, the polyolefin resin is preferably used. In the present invention, the polyolefin resin refers to a polymer containing olefin as a monomer. Specifically, homopolymers and copolymers, such as ethylene, propylene, and isobutylene, are mentioned. As the polyolefin resin, one or two or more kinds thereof can be used as required. Among the above, polyethylene is preferably used. As the polyethylene, a low density polyethylene (LDPE) and a high-density polyethylene (HDPE) are preferably used.

In the present invention, the resin layer may contain a white pigment, a fluorescent brightening agent, ultramarine, and the like in order to adjust the opacity, the degree of whiteness, and the hue. Among the above, since the opacity can be improved, the white pigment is preferably used. Examples of the white pigment include a rutile type titanium oxide or an anatase type titanium oxide. In the present invention, the content of the white pigment in the resin layer is preferably 3 g/m$^2$ or more and 30 g/m$^2$ or less. When providing the resin layer on both surfaces of the base paper, it is preferable that the total content of the white pigments in the two resin layers satisfies the range above. The content of the white pigment in the resin layer is preferably 25% by mass or less based on the resin content. When the white pigment content is larger than 25% by mass, the dispersion stability of the white pigment is not sufficiently obtained in some cases.

Ink Receiving Layer

In the present invention, the first ink receiving layer contains fumed silica. The second ink receiving layer contains colloidal silica and resin particles. In addition to the first ink receiving layer and the second ink receiving layer, an ink receiving layer may be further provided. The ink receiving layer may be provided only on one surface of the base or may be provided on both surfaces thereof. Insofar as the effects of the present invention are obtained, an aspect in which a thin layer is provided on the upper side (opposite to the base side) of the second ink receiving layer or between the first ink receiving layer and the second ink receiving layer is also included in the scope of the present invention.

The film thickness of the first ink receiving layer is preferably 10 μm or more and 60 μm or less and more preferably 15 μm or more and 45 μm or less. The film thickness of the second ink receiving layer is preferably 0.005 μm or more and 0.200 μm or less and more preferably 0.01 μm or more and 0.10 μm or less.

The total film thickness of all the ink receiving layers is preferably 10 μm or more and 60 μm or less and more preferably 15 μm or more and 45 μm or less.

Hereinafter, materials which can be contained in the first ink receiving layer and the second ink receiving layer are individually described.

Inorganic Particle

In the present invention, it is preferable for the ink receiving layer to contain inorganic particles. Examples of the inorganic particles for use in the present invention include, for example, alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium hydroxide, and the like. One or two or more kinds of these inorganic particles can be used as required.

In the present invention, the first ink receiving layer contains fumed silica as the inorganic particles. The first ink receiving layer may further contain inorganic particles other than the fumed silica. In the present invention, the second ink receiving layer contains colloidal silica as the inorganic particles. The second ink receiving layer may further contain inorganic particles other than the colloidal silica.

Hereinafter, the fumed silica used in the first ink receiving layer, the colloidal silica used in the second ink receiving layer, and alumina hydrate and fumed alumina particles capable of forming a porous structure with high ink absorbability among the inorganic particles mentioned above are individually described.

(1) Fumed Silica

In the present invention, the average primary particle size of the fumed silica is preferably 5 nm or more and 40 nm or less and more preferably 6 nm or more and nm or less. In the present invention, the average primary particle size of the fumed silica is the number-average particle size determined from the diameter of a circle having an area equal to the projected area of the primary particles of the fumed silica when observed under an electron microscope. In this case, the measurement is performed at at least 100 points.

The second average particle size of the fumed silica is preferably 10 nm or more and 500 nm or less, more preferably 30 nm or more and 300 nm or less, and particularly preferably 50 nm or more and 250 nm or less. In the present invention, the second average particle size of the fumed silica can be measured by a dynamic light scattering method.

In the present invention, the specific surface area determined by the BET method of the fumed silica is preferably 50 $m^2/g$ or more and 400 $m^2/g$ or less and more preferably 200 $m^2/g$ or more and 350 $m^2/g$ or less. Herein, the BET method is a method of adsorbing molecules and ions whose sizes are known to the surface of a sample, and then measuring the specific surface area of the sample from the adsorption amount. In the present invention, nitrogen gas is used as gas for adsorption to the sample.

Examples of commercially available fumed silica include Aerosil (manufactured by Nippon Aerosil Co., Ltd.), Reolosil QS type (manufactured by Tokuyama Corporation), and the like.

Colloidal Silica

In the present invention, the average primary particle size of the colloidal silica is preferably 20 nm or more and 100 nm or less and more preferably 30 nm or more and 80 nm or less. When the average primary particle size is smaller than 20 nm, the colloidal silica is more densely packed, and therefore the effect of an improvement of the ink absorbability is not sufficiently obtained in some cases. When the average primary particle size is larger than 100 nm, the glossiness and the scratch resistance of the recording medium are not sufficiently obtained in some cases. In the present invention, the average primary particle size of the colloidal silica is the number-average particle size of the diameter of a circle having an area equal to the projected area of the primary particles of the colloidal silica when observed under an electron microscope. In this case, the measurement is performed at at least 100 points.

In the present invention, among the colloidal silica, spherical colloidal silica is preferable because the scratch resistance and the glossiness increase. The "spherical" used herein refers to a shape in which a ratio b/a of the average major axis a of colloidal silica (50 or more and 100 or less) and the average minor axis b thereof when observed under a scanning electron microscope falls in the range of 0.80 or more and 1.00 or less. The b/a is more preferably 0.90 or more and 1.00 or less and particularly preferably 0.95 or more and 1.00 or less. Specifically, examples of commercially available colloidal silica include Quotron: PL-3, PL-3L (all manufactured by Fuso Chemical Co., Ltd.); Snowtex: 20, 20L, ZL, AK, AK-L (all manufactured by Nissan Chemical Industries), and the like.

The content of the colloidal silica in the second ink receiving layer is preferably 0.007 $g/m^2$ or more and more preferably 0.015 $g/m^2$ or more from the viewpoint of an improvement of the glossiness. The content is preferably 0.040 $g/m^2$ or less and more preferably 0.030 $g/m^2$ or less or less from the viewpoint of an improvement of the ink absorbability. The content of the colloidal silica in the second ink receiving layer is particularly preferably 0.015 $g/m^2$ or more 0.030 $g/m^2$ or less.

In the present invention, the area in which the colloidal silica exists in the recording medium surface is 10% or more and 70% or less. The area is preferably 20% or more and 60% or less and more preferably 30% or more and 60% or less. In Examples of the present invention, the area in which the colloidal silica exists in the recording medium surface was calculated by the following method.

The surface of the recording medium is observed under a scanning electron microscope S-4300 (manufactured by Hitachi High-Technologies Corporation) at a magnification of 50,000 times. The number of all the colloidal silica in an arbitrary observation region in the range of 1.78 μm×2.54 μm is counted. In this case, a colloidal silica that is partially hidden behind other colloidal silica and a colloidal silica that is partially outside the edge of the observation region are also counted as "one particle". When the obtained number of the colloidal silica is defined as N and the average primary particle size of the colloidal silica is defined as d, an area S1 in which the colloidal silica exists in the observation region is calculated as $(d/2)^2\times\pi\times N$. Then, by dividing S1 by an area S2 of the observation region, i.e., by calculating S1/S2×100, the area ratio is obtained. The calculation is similarly performed for at least three observation regions, the average value of the obtained area ratios is defined as the "area in which the colloidal silica exists in the recording medium surface".

(3) Alumina Hydrate and Fumed Alumina

As alumina hydrate, one represented by General Formula (X): $Al_2O_{3-n}(OH)_{2n}.mH_2O$ can be preferably used (In General Formula (X), n is 0, 1, 2, or 3 and m is 0 or more and 10 or less and preferably 0 or more and 5 or less. m and n are not simultaneously 0.). Since $mH_2O$ represents an aqueous phase which does not participate in the formation of the crystal lattice and which can be disconnected in many cases, m may not be an integer. When the alumina hydrate is heated, m can be 0.

The alumina hydrate can be manufactured by known methods. Specifically, examples of the methods include a method of hydrolyzing aluminum alkoxide, a method of hydrolyzing sodium aluminate, and a method of adding an aqueous solution of aluminum sulfate and aluminum chloride to an aqueous solution of sodium aluminate for neutralizing, and the like.

As the crystal structure of the alumina hydrate, an amorphous type, a gibbsite type, and a boehmite type are known according to the heat treatment temperature. The crystal structure of the alumina hydrate can be analyzed by an X-ray diffraction method. In the present invention, the boehmite type alumina hydrate or the amorphous alumina hydrate is preferable among the above. As specific examples, alumina hydrates described in Japanese Patent Laid-Open Nos. 7-232473, 8-132731, 9-66664, 9-76628 and the like and Disperal HP14, HP18 (all manufactured by Sasol) and the like as commercially-available items can be mentioned. One or two or more kinds of these alumina hydrates can be used as required.

In the present invention, the specific surface area determined by the BET method of the alumina hydrate is preferably 100 $m^2/g$ or more and 200 $m^2/g$ or less and more preferably 125 $m^2/g$ or more and 175 $m^2/g$ or less.

The average primary particle size of the alumina hydrate is preferably 5 nm or more and more preferably 10 nm or more. The average primary particle size is preferably 50 nm or less and more preferably 30 nm or less.

As the fumed alumina particles for use in the ink receiving layer, γ-alumina, α-alumina, δ-alumina, θ-alumina, χ-alumina, and the like can be used. Among the above, γ-alumina is preferably used from the viewpoint of optical density of an image and ink absorbability. As specific examples of the fumed alumina particles, AEROXIDE; Alu C, Alu130, Alu65 (all manufactured by EVONIK Industries A.G.), and the like can be mentioned.

In the present invention, the specific surface area determined by the BET method of the fumed alumina particles is preferably 50 $m^2/g$ or more and more preferably 80 $m^2/g$ or more. The specific surface area is preferably 150 $m^2/g$ or less and more preferably 120 $m^2/g$ or less.

The average primary particle size of the fumed alumina particles is preferably 5 nm or more and more preferably 11 nm or more. The average primary particle size is preferably 30 nm or less and more preferably 15 nm or less.

The alumina hydrate and the fumed alumina particles are preferably mixed as a water dispersion liquid with the coating liquid for the ink receiving layer and acid is preferably used as a dispersing agent therefor. As the acid, sulfonic acid represented by $$R—SO_3H \qquad \text{General Formula (Y):}$$

is preferably used because the effect of suppressing blurring of an image is obtained (In General Formula (Y), R represents any one of a hydrogen atom, an alkyl group in which the number of carbon atoms is 1 or more and 4 or less, and an alkenyl group in which the number of carbon atoms is 1 or more and 4 or less. R may be substituted with an oxo group, a halogen atom, an alkoxy group, and an acyl group.). The content of the acid is preferably 1.0% by mass or more and 2.0% by mass or less and more preferably 1.3% by mass or more and 1.6% by mass or less based on the total content of the alumina hydrate and the fumed alumina particles.

Resin Particle

In the present invention, the second ink receiving layer contains resin particles. Examples of the resin particles include, for example, polyethylene, polystyrene, polypropylene, polyvinyl acetate, polyurethane, polyvinyl chloride, poly(meth)acrylic acid ester, (meth)acrylic resin, maleic anhydride resin, a styrene-butadiene copolymer, an ethylene-vinyl acetate copolymer, a methyl methacrylate-butadiene copolymer, and the like. Among the above, resin particles of polyurethane, i.e., urethane resin particles, are preferably used from the viewpoint of scratch resistance.

The average particle size measured by a dynamic light scattering method of the resin particles is preferably 10 nm or more and 200 nm or less and more preferably 20 nm or more and 100 nm or less. By satisfying the range above, the glossiness and the scratch resistance of the recording medium improve. In Examples of the present invention, the average particle size of the resin particles was measured by a dynamic light scattering method using a dynamic light scattering type particle size distribution meter Microtrac UPA (manufactured by Nikkiso).

In the present invention, the glass transition temperature of the resin particles is preferably 0° C. or more and 80° C. or less and more preferably 5° C. or more and 75° C. or less. When the glass transition temperature is less than 5° C., the ink receiving layer is excessively soft, so that the improvement effect of the scratch resistance of the recording medium is not sufficiently obtained in some cases. When the glass transition temperature is more than 75° C., the colloidal silica cannot be sufficiently bonded, so that the scratch resistance of the recording medium is not sufficiently obtained in some cases.

The content of the resin particles in the second ink receiving layer is preferably 0.005 $g/m^2$ or more and 0.1 $g/m^2$ or less. When the content is smaller than 0.005 $g/m^2$, the resin particle amount is small, so that the improvement effect of the glossiness is not sufficiently obtained in some cases. When the content is larger than 0.1 $g/m^2$, the resin particle amount is large, so that the improvement effect of the ink absorbability is not obtained in some cases.

The content ($g/m^2$) of the resin particles in the second ink receiving layer is preferably 0.1 times or more and 1.0 times or less and more preferably 0.2 times or more and 0.7 times or less the content ($g/m^2$) of the colloidal silica. When the content is smaller than 0.2 times or larger than 0.7 times, the improvement effect of the glossiness is not obtained in some cases.

Binder

In the present invention, the binder refers to a material capable of bonding inorganic particles, such as colloidal silica, to form a coating film. In the present invention, it is preferable for the first ink receiving layer to contain the binder. The second ink receiving layer may also contain the binder, but the above-described resin particles play the role of the binder, and therefore another binder may not be positively contained.

In the present invention, the content of the binder in the first ink receiving layer is preferably 40% by mass or less and more preferably 30% by mass or less based on the content of the inorganic particle from the viewpoint of ink absorbability. The ratio is preferably 8% by mass or more and more preferably 15% by mass or more from the viewpoint of bonding properties of the ink receiving layers.

Examples of the binder include starch derivatives, such as oxidized starch, esterified starch, and phosphorylated starch; cellulose derivatives such as carboxymethyl cellulose and hydroxyethyl cellulose; casein, gelatin, soybean protein, polyvinyl alcohol, and derivatives thereof; polyvinylpyrrolidone; maleic anhydride resin; conjugated polymer latex, such as a styrene-butadiene copolymer and a methyl methacrylate-butadiene copolymer; acrylic polymer latex, such as polymers of acrylate and methacrylate; vinyl polymer latex, such as an ethylene-vinyl acetate copolymer; functional group-modified polymer latex of the above-mentioned polymers of monomers containing functional groups, such as carboxyl groups; those obtained by cationizing the surfaces of the above-mentioned polymers with cationic groups; those obtained by cationizing the above-mentioned polymers of which surfaces with cationic surfactants; those obtained by polymerizing monomers constituting the above-mentioned polymers in the presence of cationic polyvinyl alcohol so as to disperse the polyvinyl alcohol on the polymer surfaces; those obtained by polymerizing monomers constituting the above-mentioned polymers in a suspension/dispersion liquid of cationic colloidal particles so as to disperse the cationic colloidal particles on the polymer surfaces; aqueous binders, such as thermosetting synthetic resin, e.g., melamine resin and urea resin; polymers and copolymers of acrylate and methacrylate, such as polymethyl methacrylate; and synthetic resin, such as polyurethane resin, unsaturated polyester resin, a vinyl chloride-vinyl acetate copolymer, polyvinyl butyral, and alkyd resin. One or two or more kinds of these binders can be used as required.

Among the above-mentioned binders, polyvinyl alcohol and polyvinyl alcohol derivatives are particularly preferably used. Examples of the polyvinyl alcohol derivative include cation-modified polyvinyl alcohol, anion-modified polyvinyl alcohol, silanol-modified polyvinyl alcohol, polyvinyl acetal, and the like. As the cation-modified polyvinyl alcohol, polyvinyl alcohols having primary to tertiary amino groups or a quaternary ammonium group in the main chain or the side chain of polyvinyl alcohol described in Japanese Patent Laid-Open No. 61-10483 are preferable, for example.

The polyvinyl alcohol can be synthesized by saponifying polyvinyl acetate. The degree of saponification of the polyvinyl alcohol is preferably 80% by mol or more and 100% by mol or less and more preferably 85% by mol or more and 98% by mol or less. The degree of saponification is the ratio of the molar number of hydroxyl groups generated by a saponification reaction when polyvinyl acetate is saponified to obtain polyvinyl alcohol, and is a value measured by the method described in JIS-K6726. The average polymerization degree of the polyvinyl alcohol is preferably 2000 or more and more preferably 2000 or more and 5000 or less. In the present invention, as the average polymerization degree, the viscosity average polymerization degree determined by the method described in JIS-K6726 (1994) is used.

When preparing the coating liquid for the ink receiving layer, it is preferable to use polyvinyl alcohol and a polyvinyl alcohol derivative in the form of an aqueous solution. In this case, the solid content of the polyvinyl alcohol and the polyvinyl alcohol derivative in the aqueous solution is preferably 3% by mass or more and 20% by mass or less.

Crosslinking Agent

In the present invention, it is preferable for the ink receiving layer to contain a crosslinking agent. Examples of the crosslinking agent include aldehyde compounds, melamine compounds, isocyanate compounds, zirconium compounds, amide compounds, aluminum compounds, boric acids, boric acid salts, and the like. One or two or more kinds of these crosslinking agents can be used as required. In particular, when using polyvinyl alcohol and a polyvinyl alcohol derivative as the binder, boric acid and boric acid salts are preferably used among the above-mentioned crosslinking agents.

Examples of the boric acid include orthoboric acid ($H_3BO_3$), metaboric acid, and diboric acid. As the boric acid salt, water-soluble salts of the above-mentioned boric acids are preferable. Examples of the boric acid salt include alkali metal salts of boric acids, such as sodium salts and potassium salts of boric acids; alkaline earth metal salts of boric acids, such as magnesium salts and calcium salts of boric acids; ammonium salts of boric acids; and the like. Among these boric acids and boric acid salts, the use of the orthoboric acid is preferable from the viewpoint of stability with time of the coating liquid and the effect of suppressing the occurring of cracking.

The use amount of the crosslinking agent can be adjusted as appropriate according to the manufacturing conditions and the like. In the present invention, the content of the crosslinking agent in the ink receiving layer is preferably 1.0% by mass or more and 50% by mass or less and more preferably 5% by mass or more and 40% by mass or less based on the content of the binder.

When the binder is polyvinyl alcohol and the crosslinking agent is at least one kind selected from the boric acids and the boric acid salts, the total content of the boric acid and the boric acid salt is preferably 5% by mass or more and 30% by mass or less based on the content of the polyvinyl alcohol in the ink receiving layer.

Other Additives

In the present invention, the ink receiving layer may contain other additives other than the above-described substances. Specific examples of the additives include pH adjusters, thickeners, fluidity modifiers, antifoaming agents, foam inhibitors, surfactants, mold release agents, penetrants, color pigments, color dyes, fluorescent brightening agents, ultraviolet absorbers, antioxidants, antiseptics, antifungal agents, water resistant additives, dye-fixing agents, curing agents, and weather resistant materials.

In particular, it is preferable for the second ink receiving layer to contain a zirconium compound. By containing the same, gloss unevenness of the recording medium is suppressed. Examples of the zirconium compound include zirconium oxyacetate, zirconium oxychloride, zirconium carbonate ammonium, zirconium chloride oxyhydroxide, and the like. The zirconium compound is preferably contained as ammonium salt. Specific examples of ammonium include volatile amines, such as ammonia, methylamine, dimethylamine, trimethylamine, and the like. Among the above, zirconium carbonate ammonium is preferably used.

Undercoat Layer

In the present invention, an undercoat layer may be provided between the base and the ink receiving layer for the purpose of increasing the adhesiveness between the base and the ink receiving layer. The undercoat layer preferably contains a water-soluble polyester resin, gelatin, polyvinyl alcohol, and the like. The film thickness of the undercoat layer is preferably 0.01 μm or more and 5 μm or less.

Back Coat Layer

In the present invention, a back coat layer may be provided on a surface opposite to the surface on which the ink receiving layer is provided of the base for the purpose of increasing the handling properties, the conveyance aptitude, and the conveyance scratch resistance in continuation printing in the case of loading a large number of sheets. The back coat layer preferably contains a white pigment, a binder, and the like. The film thickness of the back coat layer is set in such a manner that the dry application amount is 1 $g/m^2$ or more and 25 $g/m^2$ or less.

Method of Manufacturing Recording Medium

In the present invention, a method of manufacturing the recording medium is preferably a method having a process of producing the base, a process of preparing the coating liquid for the ink receiving layer, and a process of applying the coating liquid for the ink receiving layer to the base. Hereinafter, the method of manufacturing the recording medium is described.

Method of Producing Base

In the present invention, as a method of producing the base paper, a generally used paper-making method can be applied. Examples of the papermaking machine include Fourdrinier paper machines, cylinder paper machines, drum paper machines, and twin wire paper machines. In order to improve the surface smoothness of the base paper, surface treatment may be performed by applying heat and pressure during the paper-making process or after the paper-making process. Specific examples of the surface treatment methods include calendar treatment, such as machine calendar and super calendar.

Examples of a method of providing a resin layer on the base paper, i.e., a method of covering the base paper with resin, include a melt extrusion method, wet lamination, dry lamination, and the like. Among the above, the melt extrusion method of pressing out molten resin to one surface or both surfaces of the base paper for coating is preferable. As the melt extrusion method, a method of contacting and pressing the conveyed base paper and the resin pressed out from an extrusion die at a nip point between a nip roller and a cooling roller to thereby laminate the resin layer onto the base paper (hereinafter also referred to as an extrusion coating method) is widely adopted. When providing the resin layer by the melt extrusion method, pretreatment may be performed in such a manner that the adhesion of the base paper and the resin layer becomes stronger. Examples of the pretreatment include acid etching treatment with a sulfuric acid-chromic acid mixture, flame treatment with a gas flame, ultraviolet exposure treatment, corona discharge treatment, glow discharge treatment, anchor coat treatment with alkyl titanate, and the like, and the like. Among the above, the corona discharge treatment is preferable. When incorporating a white pigment in the resin layer, the base paper may be covered with a mixture of the resin and the white pigment.

Method of Forming Ink Receiving Layer

In the recording medium of the present invention, as a method of forming the ink receiving layer on the base, the following method can be mentioned, for example. First, the coating liquid for the ink receiving layer is prepared. Then, by applying the coating liquid onto the base, and then drying the same, the recording medium of the present invention can be obtained. As a method of applying the coating liquid, a curtain coater, a coater using an extrusion system, a coater using a slide hopper system, and the like can be used. During the application, the coating liquid may be warmed. Examples of a drying method after the application include methods using hot air dryers, such as a linear tunnel dryer, an arch dryer, an air loop dryer, and a sine curve air float dryer and methods using a dryer utilizing infrared rays or microwaves and the like.

In the present invention, it is preferable to apply a coating liquid for the first ink receiving layer onto the base and dry the same, and then apply a coating liquid for the second ink receiving layer containing colloidal silica and resin particles and dry the same. In this case, the application amount of the coating liquid for the first ink receiving layer is preferably 5 $g/m^2$ or more and 45 $g/m^2$ or less in terms of dry solid content and the application amount of the coating liquid for the second ink receiving layer is preferably 0.01 $g/m^2$ or more and 0.5 $g/m^2$ or less in terms of dry solid content.

EXAMPLES

Hereinafter, the present invention is described in more detail with reference to Examples and Comparative Examples. The present invention is not limited by the following examples without diverting from the scope of the present invention. In the following examples, the term "part(s)" is on a mass basis unless otherwise specified.

Production of Recording Medium

Production of Base 80 parts of LBKP having a Canadian Standard Freeness of 450 mLCSF, 20 parts of NBKP having a Canadian Standard Freeness of 480 mLCSF, 0.60 part of cationized starch, 10 parts of heavy calcium carbonate, 15 parts of light calcium carbonate, 0.10 part of alkyl ketene dimer, and 0.030 part of cationic polyacrylamide were mixed, and then water was added in such a manner that the solid content was 3.0% by mass to thereby obtain a paper stuff. Subsequently, the paper stuff was formed into paper with a Fourdrinier paper machine, and then subjected to three-stage wet pressing, followed by drying with a multi-cylinder dryer. Thereafter, the resulting paper was impregnated with an aqueous oxidized starch solution in such a manner that the solid content after the drying was 1.0 $g/m^2$ using a size press apparatus, and then dried. Furthermore, the resulting paper was subjected to finishing treatment with a machine calendar to produce a base paper having a basis weight of 170 $g/m^2$, a stockigt sizing degree of 100 seconds, an air permeability of 50 seconds, a Bekk smoothness of 30 seconds, a Gurley stiffness of 11.0 mN, and a film thickness of 100 μm. Subsequently, a resin composition containing 70 parts of low-density polyethylene, parts of high-density polyethylene, and 10 parts of titanium oxide was applied onto one surface (defined as the front surface) of the base paper in such a manner that the dry application amount was 25 $g/m^2$. Furthermore, a resin composition containing 50 parts of low-density polyethylene and 50 parts of high-density polyethylene was applied onto the back surface of the base paper in such a manner that the dry application amount was 25 $g/m^2$ to obtain a base.

Preparation of Coating Liquid for Ink Receiving Layer

Preparation of First Coating Liquid 1-1

1.54 parts of polydiallyldimethylamine hydrochloride: SHALLOL DC902P (manufactured by Daiichi Kogyo Seiyaku Co., Ltd., solid content of 50% by mass) was added to 79.23 parts of ion exchanged water. 19.23 parts of fumed silica AEROSIL 300 (manufactured by EVONIK Industries A.G.) was added in a small amount while stirring the aqueous solution with a T.K. homomixer MARK II 2.5 (manufactured by Tokusyu Kika Kogyo Co., Ltd.) under the rotation conditions of 3000 rpm. Furthermore, treatment was performed twice with a Nanomizer (manufactured by Yoshida Kikai Co., Ltd.) to prepare a fumed silica dispersion liquid with a solid content of 20% by mass.

Polyvinyl alcohol PVA 235 (manufactured by Kuraray Co., Ltd.) having a viscosity average polymerization degree of 3500 and a saponification degree of 88% by mol was dissolved in ion exchanged water to prepare an aqueous binder solution having a solid content of 8.0% by mass.

The aqueous binder solution prepared above was mixed with the fumed silica dispersion liquid prepared above in such a manner that the proportion of the polyvinyl alcohol was 23.0 parts in terms of solid content based on 100 parts of the fumed silica solid content contained in the fumed silica dispersion liquid to obtain a mixture solution. Subsequently, an aqueous orthoboric acid solution (Solid content of 5% by mass) which was a crosslinking agent was mixed with the resulting mixture solution in an amount of 20.0 parts, in terms of solid content, based on 100 parts of the polyvinyl alcohol solid content contained in the mixture solution to obtain a first coating liquid 1-1.

Preparation of First Coating Liquid 1-2

0.33 parts of methanesulfonic acid was added as peptization acid to 80 parts of ion exchanged water. 19.67 parts of alumina hydrate DISPERAL HP14 (manufactured by Sasol) was added in a small amount while stirring the aqueous solution with a T.K. homomixer MARK II 2.5 (manufactured by Tokusyu Kika Kogyo Co., Ltd.) under the rotation conditions of 3000 rpm. After the completion of the addition, the mixture was stirred for 30 minutes as it was to thereby prepare an alumina hydrate dispersion liquid with a solid content of 20% by mass.

Polyvinyl alcohol PVA 235 (manufactured by Kuraray Co., Ltd.) having a viscosity average polymerization degree of 3500 and a saponification degree of 88% by mol was dissolved in ion exchanged water to prepare an aqueous binder solution having a solid content of 8.0% by mass.

The aqueous binder solution prepared above was mixed with the alumina hydrate dispersion liquid prepared above in such a manner that the proportion of the polyvinyl alcohol was 10.0 parts in terms of solid content based on 100 parts of the alumina hydrate solid content contained in the alumina hydrate dispersion liquid to give a mixture solution. Subsequently, an aqueous orthoboric acid solution (solid content of 5% by mass) which was a crosslinking agent was mixed with the obtained mixture solution in such a manner that the proportion of the aqueous orthoboric acid solution was 10.0 parts based on 100 parts of the polyvinyl alcohol solid content contained in the mixture solution to obtain a second coating liquid 1-2.

Preparation of Second Coating Liquid

Ion exchanged water, a colloidal silica dispersion liquid, a resin particle dispersion liquid (Coating liquid 2-38 and Coating liquid 2-39 each were an aqueous water-soluble resin solution), and an additive were mixed in such a manner that value of the part(s) of the solid content was a value of Table 1. Ion exchanged water was added in such a manner that the total parts was 100 parts. As the colloidal silica dispersion liquid, the resin particle dispersion liquid, and the additive, those shown in Tables 2 to 4 were used. As the water-soluble resin aqueous solution, PVA235 (manufactured by Kuraray) which was polyvinyl alcohol and PEG1000 (manufactured by Toho Chemical Industry) which was polyethylene glycol were used.

TABLE 1

Preparation conditions of second coating liquid

| Second coating liquid No. | Colloidal silica dispersion liquid: Product name | Colloidal silica dispersion liquid: Average primary particle size (nm) | Colloidal silica dispersion liquid: Content (Part) | Resin particle dispersion liquid: Product name | Resin particle dispersion liquid: Average primary particle size (nm) | Resin particle dispersion liquid: Glass transition temperature (° C.) | Resin particle dispersion liquid: Content (Part) | Additive: Type | Additive: Content (Part) |
|---|---|---|---|---|---|---|---|---|---|
| Coating liquid 2-1 | PL-3L | 35 | 0.35 | Super Flex 150 | 70 | 40 | 0.15 | — | 0 |
| Coating liquid 2-2 | PL-3L | 35 | 0.11 | Super Flex 150 | 70 | 40 | 0.15 | — | 0 |
| Coating liquid 2-3 | PL-3L | 35 | 0.23 | Super Flex 150 | 70 | 40 | 0.15 | — | 0 |
| Coating liquid 2-4 | PL-3L | 35 | 0.45 | Super Flex 150 | 70 | 40 | 0.15 | — | 0 |
| Coating liquid 2-5 | PL-3L | 35 | 0.61 | Super Flex 150 | 70 | 40 | 0.15 | — | 0 |
| Coating liquid 2-6 | MP-1040 | 100 | 0.35 | Super Flex 150 | 70 | 40 | 0.15 | — | 0 |
| Coating liquid 2-7 | PL-20 | 200 | 0.35 | Super Flex 150 | 70 | 40 | 0.15 | — | 0 |
| Coating liquid 2-8 | Snowtex20 | 20 | 0.35 | Super Flex 150 | 70 | 40 | 0.15 | — | 0 |
| Coating liquid 2-9 | Snowtex S | 10 | 0.35 | Super Flex 150 | 70 | 40 | 0.15 | — | 0 |
| Coating liquid 2-10 | PL-3L | 35 | 0.35 | Super Flex 860 | 200 | 36 | 0.15 | — | 0 |
| Coating liquid 2-11 | PL-3L | 35 | 0.35 | Super Flex 110 | 90 | 48 | 0.15 | — | 0 |
| Coating liquid 2-12 | PL-3L | 35 | 0.35 | Super Flex 830 | 20 | 68 | 0.15 | — | 0 |
| Coating liquid 2-13 | PL-3L | 35 | 0.35 | Super Flex 126 | 10 | 72 | 0.15 | — | 0 |
| Coating liquid 2-14 | PL-3L | 35 | 0.35 | Super Flex 170 | 20 | 75 | 0.15 | — | 0 |
| Coating liquid 2-15 | PL-3L | 35 | 0.35 | Super Flex 130 | 20 | 101 | 0.15 | — | 0 |

TABLE 1-continued

| Preparation conditions of second coating liquid | | | | | | | | | |
|---|---|---|---|---|---|---|---|---|---|
| | Colloidal silica dispersion liquid | | | Resin particle dispersion liquid | | | | Additive | |
| Second coating liquid No. | Product name | Average primary particle size (nm) | Content (Part) | Product name | Average primary particle size (nm) | Glass transition temperature (° C.) | Content (Part) | Type | Content (Part) |
| Coating liquid 2-16 | PL-3L | 35 | 0.35 | Super Flex 840 | 20 | 5 | 0.15 | — | 0 |
| Coating liquid 2-17 | PL-3L | 35 | 0.35 | Super Flex 460 | 30 | −21 | 0.15 | — | 0 |
| Coating liquid 2-18 | PL-3L | 35 | 0.35 | Super Flex 150 | 70 | 40 | 1.52 | — | 0 |
| Coating liquid 2-19 | PL-3L | 35 | 0.35 | Super Flex 150 | 70 | 40 | 3.04 | — | 0 |
| Coating liquid 2-20 | PL-3L | 35 | 0.35 | Super Flex 150 | 70 | 40 | 0.08 | —T | 0 |
| Coating liquid 2-21 | PL-3L | 35 | 0.35 | Super Flex 150 | 70 | 40 | 0.03 | — | 0 |
| Coating liquid 2-22 | PL-3L | 35 | 0.35 | Mowinyl 880 | 100 | 3 | 0.15 | — | 0 |
| Coating liquid 2-23 | PL-3L | 35 | 0.35 | Mowinyl 742A | 90 | 45 | 0.15 | — | 0 |
| Coating liquid 2-24 | PL-3L | 35 | 0.35 | Sumika Flex 752 | 500 | 15 | 0.15 | — | 0 |
| Coating liquid 2-25 | PL-3L | 35 | 0.35 | Super Flex 150 | 70 | 40 | 0.15 | Zirconium carbonate ammonium | 1.14 |
| Coating liquid 2-26 | PL-3L | 35 | 0.35 | Super Flex 150 | 70 | 40 | 0.15 | Zirconium carbonate potassium | 1.14 |
| Coating liquid 2-27 | PL-3L | 35 | 0.35 | Super Flex 150 | 70 | 40 | 0.15 | Zirconium acetate | 1.14 |
| Coating liquid 2-28 | PL-3L | 35 | 0.35 | Super Flex 150 | 70 | 40 | 0.15 | Polyaluminum chloride | 1.14 |
| Coating liquid 2-29 | PL-3L | 35 | 0.35 | Super Flex 150 | 70 | 40 | 0.15 | Aluminum sulfate | 1.14 |
| Coating liquid 2-30 | PL-3L | 35 | 0.35 | Super Flex 150 | 70 | 40 | 0.15 | Magnesium chloride | 1.14 |
| Coating liquid 2-31 | PL-3L | 35 | 0.35 | Super Flex 150 | 70 | 40 | 0.15 | sodium carbonate | 1.14 |
| Coating liquid 2-32 | PL-3L | 35 | 0.35 | Super Flex 150 | 70 | 40 | 0.15 | Cationic polymer | 1.14 |
| Coating liquid 2-33 | PL-3L | 35 | 0.03 | Super Flex 150 | 70 | 40 | 0.15 | — | 0 |
| Coating liquid 2-34 | PL-3L | 35 | 0.68 | Super Flex 150 | 70 | 40 | 0.15 | — | 0 |
| Coating liquid 2-35 | PL-3L | 35 | 1.51 | Super Flex 150 | 70 | 40 | 0.15 | — | 0 |
| Coating liquid 2-36 | PL-3L | 35 | 0.35 | — | — | — | 0 | — | 0 |
| Coating liquid 2-37 | — | — | 0 | Super Flex 150 | 70 | 40 | 0.15 | — | 0 |
| Coating liquid 2-38 | PL-3L | 35 | 0.35 | PVA235 | — | — | 0.15 | — | 0 |
| Coating liquid 2-39 | PL-3L | 35 | 0.35 | PEG1000 | — | — | 0.15 | — | 0 |

TABLE 2

| Type of colloidal silica dispersion liquid | | |
|---|---|---|
| Product name | Manufacturer name | Average primary particle size (nm) |
| PL-3L | Fuso Chemical Co., Ltd.); | 35 |
| PL-20 | | 200 |
| MP-1040 | Nissan Chemical | 100 |
| Snowtex 20 | Industries | 20 |
| Snowtex S | | 10 |

TABLE 3

| Type of resin particle dispersion liquid | | | | |
|---|---|---|---|---|
| Product name | Type | Manufacturer name | Average particle size measured by dynamic light scattering method (nm) | Glass transition tem-perature (° C.) |
| Super Flex150 | Urethane resin | Daiichi Kogyo Seiyaku Co., Ltd. | 70 | 40 |

TABLE 3-continued

| Type of resin particle dispersion liquid | | | | |
|---|---|---|---|---|
| Product name | Type | Manufacturer name | Average particle size measured by dynamic light scattering method (nm) | Glass transition temperature (° C.) |
| Super Flex 860 | Urethane resin | | 200 | 36 |
| Super Flex 110 | Urethane resin | | 90 | 48 |
| Super Flex 830 | Urethane resin | | 20 | 68 |
| Super Flex 126 | Urethane resin | | 10 | 72 |
| Super Flex 170 | Urethane resin | | 20 | 75 |
| Super Flex 130 | Urethane resin | | 20 | 101 |
| Super Flex 840 | Urethane resin | | 20 | 5 |
| Super Flex 460 | Urethane resin | | 30 | −21 |
| Mowinyl 880 | Acrylic resin | Nippon Synthetic Chemical | 100 | 3 |
| Mowinyl 742A | Acrylic resin | Industry Co., Ltd. | 90 | 45 |
| Sumika Flex 752 | Ethylene-vinyl acetate copolymer | Sumika Chemtex Co., Ltd. | 500 | 15 |

TABLE 4

| Type of additives | | |
|---|---|---|
| Type | Product name | Manufacturer name |
| Zirconium carbonate ammonium | AC7 | Daiichi Kigenso Kagaku Kogyo Co., Ltd. |
| Zirconium carbonate potassium | ZK-10M | |
| Zirconium acetate | ZA-30 | |
| Polyaluminum chloride | HAP25 | RIKENGREEN CO., LTD. |
| Aluminum sulfate | — | Central Glass Co., Ltd. |
| Magnesium chloride | — | Kishida Chemical Co., Ltd. |
| Sodium carbonate | — | |

TABLE 4-continued

| Type of additives | | |
|---|---|---|
| Type | Product name | Manufacturer name |
| Cationic polymer | SHALLO DC902P | Daiichi Kogyo Seiyaku Co., Ltd. |

Production of Recording Medium

Recording media were produced as follows using the base, the first coating liquid, and the second coating liquid obtained above. The combination of the first coating liquid and the second coating liquid which were used, the content (g/m$^2$) of each material in the second ink receiving layer and the ratio (times) thereof, and the area (%) in which the colloidal silica exits in the recording medium surface each were measured and calculated by the methods described above. The results are shown in Table 5.

Example 1 to 32 and Comparative Examples 3 to 9

The first coating liquid 1-1 warmed to 40° C. was applied onto the base using a slide die in such a manner that the solid content in drying was 23 g/m$^2$. The air of a temperature of 50° C. and a relative humidity of 10% was applied for drying. Subsequently, the second coating liquid was applied using a mayer bar in such a manner that the content (g/m$^2$) of the colloidal silica in the ink receiving layer was a specific value. Then, the drying was performed at a temperature of 60° C. to thereby obtain a recording medium.

Comparative Example 1

The first coating liquid 1-2 warmed to 40° C. was applied onto the base using a slide die in such a manner that the solid content in drying was 35 g/m$^2$. The air of a temperature of 50° C. and a relative humidity of 10% was applied for drying. Subsequently, the second coating liquid was applied using a mayer bar in such a manner that the content (g/m$^2$) of the colloidal silica in the ink receiving layer was a specific value. Then, the drying was performed at a temperature of 60° C. to thereby obtain a recording medium.

Comparative Example 2

The first coating liquid 1-1 warmed to 40° C. was applied onto the base using a slide die in such a manner that the solid content in drying was 23 g/m$^2$. The air of a temperature of 50° C. and a relative humidity of 10% was applied for drying.

TABLE 5

| Production conditions and physical properties of recording medium | | | | | | | |
|---|---|---|---|---|---|---|---|
| | Combination of coating liquids | | Physical properties of second ink receiving layer | | | | Area in which colloidal silica exists in recording medium surface (%) |
| | | | Content in second ink receiving layer (g/m$^2$) | | | Ratio of content (g/m$^2$) (Times) | |
| Example No. | First coating liquid No. | Second coating liquid No. | Colloidal silica | Resin particles | Additive | Resin particles/ Colloidal silica | |
| Ex. 1 | Coating liquid1-1 | Coating liquid2-1 | 0.023 | 0.010 | 0 | 0.43 | 39 |
| Ex. 2 | Coating liquid1-1 | Coating liquid2-2 | 0.007 | 0.010 | 0 | 1.43 | 11 |
| Ex. 3 | Coating liquid1-1 | Coating liquid2-3 | 0.015 | 0.010 | 0 | 0.67 | 29 |
| Ex. 4 | Coating liquid1-1 | Coating liquid2-4 | 0.030 | 0.010 | 0 | 0.33 | 58 |
| Ex. 5 | Coating liquid1-1 | Coating liquid2-5 | 0.040 | 0.010 | 0 | 0.25 | 70 |
| Ex. 6 | Coating liquid1-1 | Coating liquid2-6 | 0.023 | 0.010 | 0 | 0.43 | 29 |
| Ex. 7 | Coating liquid1-1 | Coating liquid2-7 | 0.023 | 0.010 | 0 | 0.43 | 22 |
| Ex. 8 | Coating liquid1-1 | Coating liquid2-8 | 0.023 | 0.010 | 0 | 0.43 | 45 |
| Ex. 9 | Coating liquid1-1 | Coating liquid2-9 | 0.023 | 0.010 | 0 | 0.43 | 50 |

TABLE 5-continued

| Production conditions and physical properties of recording medium | | | | | | | |
|---|---|---|---|---|---|---|---|
| | Combination of coating liquids | | Physical properties of second ink receiving layer: Content in second ink receiving layer ($g/m^2$) | | | Ratio of content ($g/m^2$) (Times) | Area in which colloidal silica exists in recording medium surface (%) |
| Example No. | First coating liquid No. | Second coating liquid No. | Colloidal silica | Resin particles | Additive | Resin particles/ Colloidal silica | |
| Ex. 10 | Coating liquid1-1 | Coating liquid2-10 | 0.023 | 0.010 | 0 | 0.43 | 42 |
| Ex. 11 | Coating liquid1-1 | Coating liquid2-11 | 0.023 | 0.010 | 0 | 0.43 | 38 |
| Ex. 12 | Coating liquid1-1 | Coating liquid2-12 | 0.023 | 0.010 | 0 | 0.43 | 39 |
| Ex. 13 | Coating liquid1-1 | Coating liquid2-13 | 0.023 | 0.010 | 0 | 0.43 | 36 |
| Ex. 14 | Coating liquid1-1 | Coating liquid2-14 | 0.023 | 0.010 | 0 | 0.43 | 40 |
| Ex. 15 | Coating liquid1-1 | Coating liquid2-15 | 0.023 | 0.010 | 0 | 0.43 | 39 |
| Ex. 16 | Coating liquid1-1 | Coating liquid2-16 | 0.023 | 0.010 | 0 | 0.43 | 38 |
| Ex. 17 | Coating liquid1-1 | Coating liquid2-17 | 0.023 | 0.010 | 0 | 0.43 | 37 |
| Ex. 18 | Coating liquid1-1 | Coating liquid2-18 | 0.023 | 0.100 | 0 | 4.35 | 40 |
| Ex. 19 | Coating liquid1-1 | Coating liquid2-19 | 0.023 | 0.200 | 0 | 8.70 | 39 |
| Ex. 20 | Coating liquid1-1 | Coating liquid2-20 | 0.023 | 0.005 | 0 | 0.22 | 40 |
| Ex. 21 | Coating liquid1-1 | Coating liquid2-21 | 0.023 | 0.002 | 0 | 0.09 | 38 |
| Ex. 22 | Coating liquid1-1 | Coating liquid2-22 | 0.023 | 0.010 | 0 | 0.43 | 41 |
| Ex. 23 | Coating liquid1-1 | Coating liquid2-23 | 0.023 | 0.010 | 0 | 0.43 | 38 |
| Ex. 24 | Coating liquid1-1 | Coating liquid2-24 | 0.023 | 0.010 | 0 | 0.43 | 43 |
| Ex. 25 | Coating liquid1-1 | Coating liquid2-25 | 0.023 | 0.010 | 0.075 | 0.43 | 39 |
| Ex. 26 | Coating liquid1-1 | Coating liquid2-26 | 0.023 | 0.010 | 0.075 | 0.43 | 41 |
| Ex. 27 | Coating liquid1-1 | Coating liquid2-27 | 0.023 | 0.010 | 0.075 | 0.43 | 39 |
| Ex. 28 | Coating liquid1-1 | Coating liquid2-28 | 0.023 | 0.010 | 0.075 | 0.43 | 36 |
| Ex. 29 | Coating liquid1-1 | Coating liquid2-29 | 0.023 | 0.010 | 0.075 | 0.43 | 38 |
| Ex. 30 | Coating liquid1-1 | Coating liquid2-30 | 0.023 | 0.010 | 0.075 | 0.43 | 39 |
| Ex. 31 | Coating liquid1-1 | Coating liquid2-31 | 0.023 | 0.010 | 0.075 | 0.43 | 37 |
| Ex. 32 | Coating liquid1-1 | Coating liquid2-32 | 0.023 | 0.010 | 0.075 | 0.43 | 44 |
| Comp. Ex. 1 | Coating liquid1-2 | Coating liquid2-1 | 0.023 | 0.010 | 0 | 0.43 | 39 |
| Comp. Ex. 2 | Coating liquid1-1 | — | — | — | — | — | 0 |
| Comp. Ex. 3 | Coating liquid1-1 | Coating liquid2-33 | 0.005 | 0.010 | 0 | 2.00 | 8 |
| Comp. Ex. 4 | Coating liquid1-1 | Coating liquid2-34 | 0.045 | 0.010 | 0 | 0.22 | 85 |
| Comp. Ex. 5 | Coating liquid1-1 | Coating liquid2-35 | 0.100 | 0.010 | 0 | 0.10 | 91 |
| Comp. Ex. 6 | Coating liquid1-1 | Coating liquid2-36 | 0.023 | 0 | 0 | — | 39 |
| Comp. Ex. 7 | Coating liquid1-1 | Coating liquid2-37 | 0 | 0.010 | 0 | — | 0 |
| Comp. Ex. 8 | Coating liquid1-1 | Coating liquid2-38 | 0.023 | 0 | 0 | — | 38 |
| Comp. Ex. 9 | Coating liquid1-1 | Coating liquid2-39 | 0.023 | 0 | 0 | — | 38 |

Evaluation

Evaluation of Glossiness

The 60° gloss of the recording media was measured by a method described in JIS-Z8741 using a glossmeter VG-2000 (manufactured by Nippon Denshoku Industries Co., LTD.), and then the glossiness was evaluated based on the following criteria. The evaluation criteria are as follows. The evaluation results are shown in Table 6.

A: The 60° gloss was 60% or more.

B: The 60° gloss was 50% or more and less than 60%.

C: The 60° gloss was 40% or more and less than 50%.

D: The 60° gloss was 30% or more and less than 40%.

E: The 60° gloss was less than 30%.

Evaluation of Ink Absorbability

An ink cartridge BCI-321 (manufactured by CANON KABUSHIKI KAISHA) was attached to an ink jet recording apparatus PIXUS MP990 (manufactured by CANON KABUSHIKI KAISHA). Then, on the recording media, four green solid images with a recording duty of 200%, 250%, 300%, and 350% were recorded under the conditions of a temperature of 23° C. and a relative humidity of 50% using the ink jet recording apparatus described above. In the ink jet recording apparatus, the image recorded under the conditions where one droplet of an about 11 ng ink was added to a unit region (1/600 inch×1/600 inch) at a resolution of 600 dpi×600 dpi is defined as an image with a recording duty of 100%. By visually confirming whether a beading phenomenon occurred in the obtained images, the ink absorbability was evaluated. The beading phenomenon is a phenomenon in which ink droplets before being absorbed into a recording medium are combined and is known to have a high correlation with the ink absorbability. More specifically, when the beading phenomenon does not occur in the images with a high recording duty, it can be judged that the ink absorbability of the recording medium is high. The evaluation criteria are as follows. In the present invention, A to C in the following evaluation criteria are preferable levels and D and E are non-permissible levels. The evaluation results are shown in Table 6.

A: Even in the image with a recording duty of 350%, the beading phenomenon did not occur.

B: In the image with a recording duty of 350%, the beading phenomenon occurred but in the image with a recording duty of 300%, the beading phenomenon did not occur.

C: In the image with a recording duty of 300%, the beading phenomenon occurred but, in the image with a recording duty of 250%, the beading phenomenon did not occur.

D: In the image with a recording duty of 250%, the beading phenomenon occurred but, in the image with a recording duty of 200%, the beading phenomenon did not occur.

E: Even in the image with a recording duty of 200%, the beading phenomenon occurred.

Evaluation of Scratch Resistance

The scratch resistance of the recording media was evaluated using the Gakushin-Type Rubbing Tester II type (manufactured by TESTER SANGYO CO., LTD.) according to JIS-L0849. Specifically, the evaluation was performed as follows. Each recording medium was set on a vibration table of the rubbing tester in such a manner that the ink receiving layer side faced upward. Then, one in which a Kim Towel was attached to a friction element on which a 100 g weight was placed was moved back and forth five times in such a manner as to rub the front surface of the recording medium. Thereafter, the 75° gloss of the rubbed region and the region which was not rubbed was measured, and then a difference in the 75° gloss [=(75° gloss of rubbed region)−(75° gloss of region which was not rubbed)] was calculated. Since the rubbed region has such a tendency that, as the scratch resistance of a recording medium is lower, the 75° gloss becomes more, and therefore the difference in the 75° gloss becomes larger. The 75° gloss was measured by a method described in JIS-Z8741. The evaluation criteria are as follows. In the present invention, A to C in the following evaluation criteria are preferable levels and D and E are non-permissible levels. The evaluation results are shown in Table 6.

A: The difference in the 75° gloss was less than 5%.

B: The difference in the 75° gloss was 5% or more and less than 10%.

C: The difference in the 75° gloss was 10% or more and less than 15%.

D: The difference in the 75° gloss was 15% or more and less than 20%.

E: The difference in the 75° gloss was 20% or more.

TABLE 6

| | Evaluation results | | |
|---|---|---|---|
| | Evaluation results | | |
| Example No. | Glossiness | Ink absorbability | Scratch resistance |
| Ex. 1 | A | A | A |
| Ex. 2 | C | A | A |
| Ex. 3 | B | A | A |
| Ex. 4 | A | B | A |
| Ex. 5 | A | C | A |
| Ex. 6 | B | A | B |
| Ex. 7 | C | A | C |
| Ex. 8 | A | A | A |
| Ex. 9 | A | B | A |
| Ex. 10 | B | A | C |
| Ex. 11 | A | A | B |
| Ex. 12 | A | A | A |
| Ex. 13 | A | A | A |
| Ex. 14 | A | A | B |
| Ex. 15 | A | A | C |
| Ex. 16 | B | B | B |
| Ex. 17 | B | B | C |
| Ex. 18 | A | B | A |
| Ex. 19 | A | C | A |
| Ex. 20 | B | A | B |
| Ex. 21 | C | A | B |
| Ex. 22 | A | A | C |
| Ex. 23 | A | A | B |
| Ex. 24 | A | A | C |
| Ex. 25 | A | A | A |
| Ex. 26 | A | A | A |
| Ex. 27 | A | A | A |
| Ex. 28 | A | A | A |
| Ex. 29 | A | A | A |

TABLE 6-continued

| | Evaluation results | | |
|---|---|---|---|
| | Evaluation results | | |
| Example No. | Glossiness | Ink absorbability | Scratch resistance |
| Ex. 30 | B | A | A |
| Ex. 31 | B | A | A |
| Ex. 32 | C | B | A |
| Comp. Ex. 1 | D | A | D |
| Comp. Ex. 2 | D | A | D |
| Comp. Ex. 3 | D | A | A |
| Comp. Ex. 4 | A | D | A |
| Comp. Ex. 5 | A | D | A |
| Comp. Ex. 6 | D | A | C |
| Comp. Ex. 7 | D | A | D |
| Comp. Ex. 8 | D | C | D |
| Comp. Ex. 9 | D | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-163275 filed Aug. 6, 2013, which is hereby incorporated by reference herein in its entirety.

What is claimed is:

1. A recording medium, comprising: a base, a first ink receiving layer, and a second ink receiving layer that is an outermost layer in the stated order, wherein the first ink receiving layer is a layer adjacent to the second ink receiving layer, the first ink receiving layer contains a fumed silica, the second ink receiving layer contains a colloidal silica and a polymer particle, and an area in which the colloidal silica exists in a surface of the recording medium is 10% or more and 70% or less.

2. The recording medium according to claim 1, wherein an average primary particle size of the colloidal silica is 20 nm or more and 100 nm or less.

3. The recording medium according to claim 1, wherein a content of the colloidal silica in the second ink receiving layer is 0.015 $g/m^2$ or more and 0.030 $g/m^2$ or less.

4. The recording medium according to claim 1, wherein an average particle size of the resin particle measured by a dynamic light scattering method is 20 nm or more and 100 nm or less.

5. The recording medium according to claim 1, wherein a glass transition temperature of the resin particle is 5° C. or more and 75° C. or less.

6. The recording medium according to claim 1, wherein a content of the resin particle in the second ink receiving layer is 0.005 $g/m^2$ or more and 0.1 $g/m^2$ or less.

7. The recording medium according to claim 1, wherein a content ($g/m^2$) of the resin particle in the second ink receiving layer to the content ($g/m^2$) of the colloidal silica is 0.2 times or more and 0.7 times or less.

8. The recording medium according to claim 1, wherein the resin particle is a urethane resin particle.

9. The recording medium according to claim 1, wherein the second ink receiving layer contains a zirconium compound.

* * * * *